United States Patent [19]

Takayanagi

[11] Patent Number: 4,908,593

[45] Date of Patent: Mar. 13, 1990

[54] SOLENOID APPARATUS

[75] Inventor: Makoto Takayanagi, Toyokawa, Japan

[73] Assignee: Aisin Seiki Kabushiki Kaisha, Japan

[21] Appl. No.: 246,108

[22] Filed: Sep. 19, 1988

[30] Foreign Application Priority Data

Sep. 17, 1987 [JP] Japan ..... 62-233484

[51] Int. Cl.[4] ..... H01F 7/08

[52] U.S. Cl. ..... 335/255; 335/281

[58] Field of Search ..... 335/126, 131, 132, 133, 335/251, 255, 278, 281

[56] References Cited

U.S. PATENT DOCUMENTS 4,476,450 10/1984 Brown ..... 335/131 X
4,540,962 9/1985 Gresley et al. ..... 335/255 X
4,683,454 7/1987 Vollmer et al. ..... 335/255 X
4,728,916 3/1988 Fontecchio et al. ..... 335/255

*Primary Examiner*—George Harris
*Attorney, Agent, or Firm*—Sughrue, Mion, Zinn, Macpeak & Seas

[57] ABSTRACT

A solenoid apparatus includes a core of magnetic material and a plunger of magnetic material movably mounted at one end of the core. A bobbin is disposed about the core and the plunger and an electric coil is wound thereon. A U-shaped yoke extends over one end of the core and is secured thereto. Opposite ends of the wire forming the coil are connected to first and second terminals, one of which is connected to the positive lead wire and the other of which is connected to the yoke, whereby the yoke acts as the ground connection.

4 Claims, 3 Drawing Sheets

SOLENOID APPARATUS

BACKGROUND OF THE INVENTION

The present invention is directed to a solenoid apparatus and more particularly to a solenoid apparatus using a magnetic material yoke as the electrical ground.

A conventional solenoid apparatus is usually provided with a metal casing in which are incorporated a bobbin having a coil, a magnetic material core, a magnetic material plunger and a magnetic material yoke. In such a conventional solenoid apparatus, one end of the coil is usually connected to the casing so that the casing can be used as the ground line thereby reducing the number of wiring connections and assembling time. Generally, one end of the coil is connected to the casing by soldering or clinching, using an insulated lead wire.

In Japanese Utility Model Published Application No. 5956713, which is assigned to the same Assignee as the present application, it was proposed to form a resilient projection on the ground terminal of the coil which extends into resilient contact with the casing to electrically connect the projection to the casing by a subsequent clinching operation.

In recent years, the metal casing of conventional solenoid assemblies has been replaced by a casing made of synthetic resin material because of the lower cost. In such a case, it is not possible to use the casing as the ground line and therefore, a separate lead wire must be provided for the ground which must be connected to the common ground line such as a grounded body upon assembling of the solenoid. As a result, there are drawbacks since the number of wires and the assembling time are increased.

SUMMARY OF THE INVENTION

It is an object of the present invention to provide a solenoid apparatus which is capable of using a synthetic resin casing and to reduce the number of parts and assembling time.

It is a further object of the present invention to provide a solenoid apparatus having a core of magnetic material, a plunger of magnetic material movably disposed at one end of said core, a bobbin surrounding at least a portion of said core and plunger, an electric coil wound on said bobbin, a first terminal mounted on said bobbin and connected to one end of said electric coil and having a first connection arm electrically connected thereto, a second terminal mounted on said bobbin and connected to the other end of said electric coil, a yoke of magnetic material connected to the opposite end of said core and covering at least a portion of said electric coil and a second connection arm connected to said yoke and said first connection arm to electrically connect said bobbin coil to said yoke.

The foregoing and other objects, features and advantages of the present invention will be apparent from the following more particular description of the preferred embodiment of the invention as illustrated in the accompanying drawings.

DETAILED DESCRIPTION OF THE INVENTION

Figure 1:
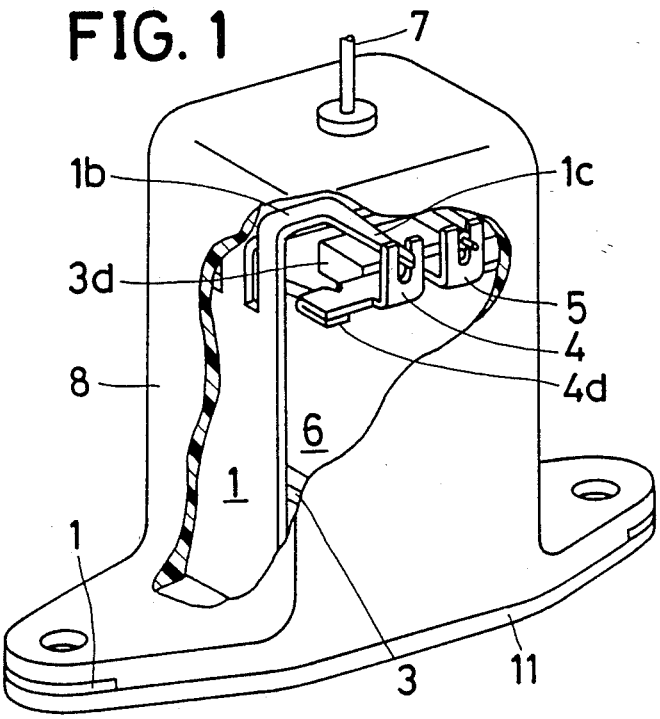
FIG. 1 is a partially cutaway perspective view of a solenoid valve according to a preferred embodiment of the present invention.
Figure 2:
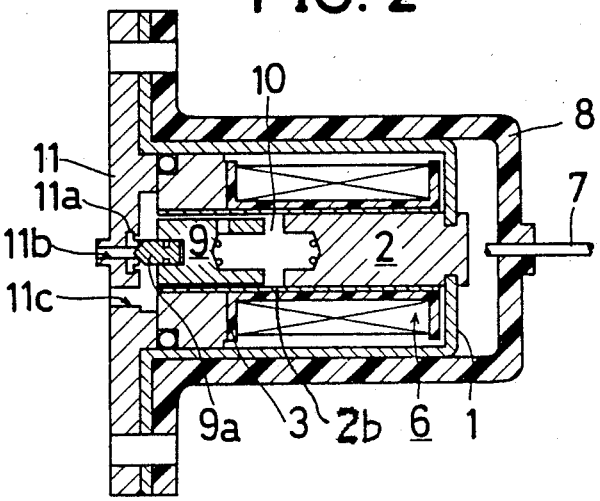
FIG. 2 a transverse sectional view of the solenoid valve of FIG. 1.

In the embodiment of the invention as disclosed in FIGS. 1–4, the solenoid valve is disposed in a casing made of molded synthetic resin material. The yoke 1 has a U-shaped configuration and is made of magnetic material. A part corresponding to the base of the U-shaped yoke 1 is connected to the rear end of a core 2. Each end of the yoke is connected to a metallic base plate 11 and the casing. A sleeve **2*b* of magnetic material covers the outer circumference of the core 2 and extends to the left of the core as viewed in FIG. 2 for slidably guiding the plunger 9. A bobbin 3 is mounted on the outer surface of the sleeve 2 *b* and an electric coil 6 is wound thereon. A valve member 9*a* is secured to the end of the plunger 9 opposite the core 2. A coil spring 10 is compressed between the plunger and the core 2 for biasing the plunger 9 to the left as viewed in FIG. 2 into engagement with a valve seat 11*a* which surrounds the output port 11*b* in the base plate 11. An input port 11*c* is also provided in the base plate 11. As shown in FIG. 2, the plunger 9 is biased by the spring 10 into engagement with the valve seat 11*a* to close the output port 11*b***.

When the electric coil 6 is energized, a magnetic flux is generated along the axis of the coil so as to draw the plunger 9 toward the core 2 against the bias of the spring 10. Thus, the valve member **9*a* will move away from the valve seat 11*a* thereby providing communication between the input port 11*c* and the output port 11*b***.

Figure 4:
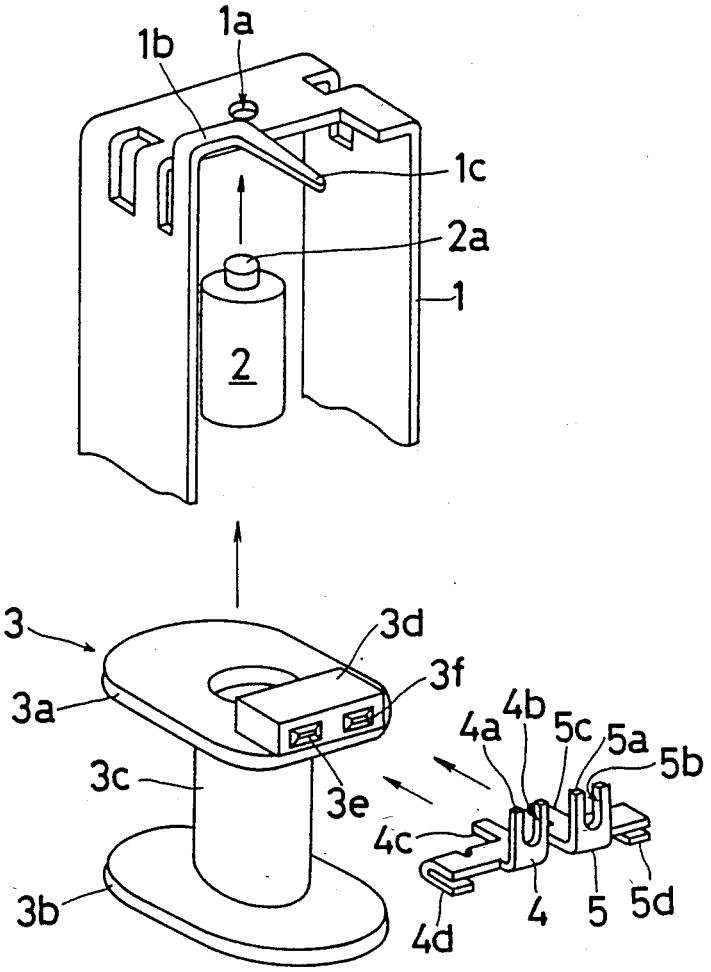
FIG. 4 is a fragmentary perspective exploded view of the solenoid valve of FIG. 1.

As shown in FIG. 4, the side edge of the U-shaped yoke 1 is formed with with an L-shaped projection **1*b* which is of integral one piece construction with the yoke so as to be electrically connected thereto. The L-shaped projection is provided with a pointed connection arm 1*c*. A circular hole 1*a* is provided in the center of the base of the U-shaped yoke 1 and a cylindrical projection 2*a* is formed on one end of the core 2. The projection 2*a*** is fitted in the hole l*a* and secured therein by any suitable means such as swaging or peening.

Figure 3:
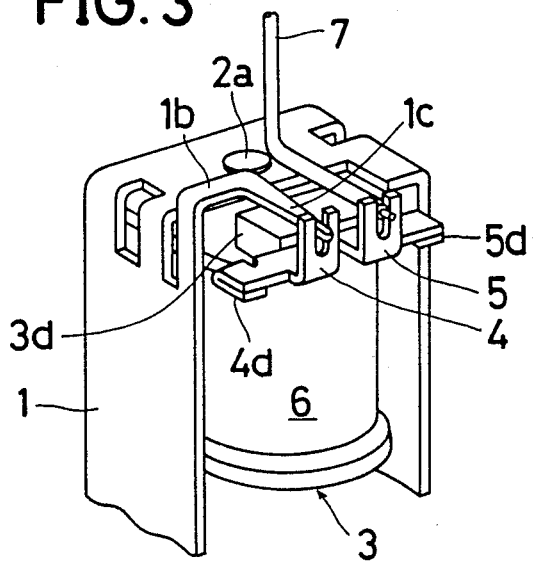
FIG. 3 is a fragmentary perspective view of the solenoid valve of FIG. 1.

The bobbin 3 is provided with flange portions **3*a* and 3*b* on opposite ends of a hollow tube 3*c*. A socket member 3*d* is secured on the flange 3*a* and is provided with a socket 3e for receiving the ground terminal 4 and a socket 3*f* for receiving the positive terminal 5, as shown in FIGS. 1, 3 and 4. The ground terminal 4 is comprised of a copper plate having a receiving arm 4*a* with a U-shaped groove 4*b* therein, a plug portion 4*c* and a wire connection part 4*d*. The receiver arm 4*a* is bent upwardly out of the plane of the copper plate and the wire connection part 4*d* is bent downwardly and rearwardly relative to the plane of the copper plate. The positive terminal 5 has substantially the same configuration as the ground terminal and is provided with a wire receiving portion 5*a*, a plug portion 5*c* and a wire connection portion 5*d*. The plug portion 4*c* of the ground terminal 4 is inserted and electrically connected to the socket 3*e* and the plug portion 5*c* is inserted in and electrically connected to the socket 3*f***.

The electric coil 6 is formed by winding a wire covered with insulating paint on the tubular portion **3*c* of the bobbin 3. At the beginning of the winding operation, one end of the wire is fixed temporarily to the wire connection part 5***d* of the positive terminal 5. At the completion of the winding, the opposite end of the wire forming the electric coil is fixed temporarily to the wire connection portion 4*d* of the ground terminal 4. Subsequently, the wire ends are permanently secured to the wire connection portions 4*d* and 5*d* by a clinching operation. The insulating paint on each end of the wire is melted by heating, whereby an electrically conductive coupling is provided between the wire and the terminals. The heating of the wire is achieved by passing electricity through the wire.

The bobbin 3 having the electric coil 6 wound thereon is connected to the yoke 1 and the core 2 which were previously connected together as shown in FIG. 3. The connection arm 1*c* formed on the yoke 1 is inserted in the U-shaped groove 4*b* formed in the receiver arm 4*a* of the ground terminal 4 upon sliding the bobbin over the core. The connection arm 1*c* is then electrically connected to the receiver arm 4*a* by soldering. The other elements of the solenoid valve are then assembled and one end of the lead wire 7 as shown in FIG. 3 is disposed in the U-shaped groove 5*b* of the receiver arms 5*a* of the positive terminal 5 and electrically connected thereto by means of soldering. The casing 8 is formed by resin mold to complete the solenoid valve assembly as shown in FIG. 1.

Figure 5:
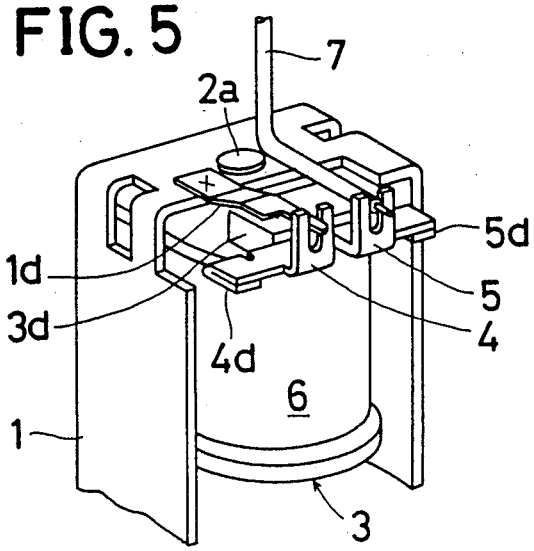
FIG. 5 is a fragmentary perspective view of a solenoid valve according to another modification.

In the solenoid valve assembly according to the present invention, the ground connection is provided through the ground terminal 4, connection arm 1*c*, the yoke 1 and the base plate 11. In the embodiment of FIGS. 1–4 inclusive, the connection arm 1*c* is formed of integral, one piece construction with the yoke 1. However, the embodiment as shown in FIG. 5 the yoke and the connection arm are separately formed and the connection arm 1*d* which is comprised of a copper plate, is secured to a corresponding portion of the base of the U-shaped yoke 1 by spot welding.

While the invention has been particularly shown and described with reference to preferred embodiments thereof, it will be understood by those in the art that the foregoing and other changes in form and detail may be made therein without departing from the spirit and scope of the invention.

What is claimed is:

1. A solenoid apparatus comprising:

a core of magnetic material;

a plunger of magnetic material movably disposed at one end of said core;

a bobbin surrounding at least a portion of each of said core and said plunger;

an electric coil wound in said bobbin;

a first terminal mounted on said bobbin and connected to one end of said electric coil with said first terminal having a first connection arm electrically connected thereto;

a second terminal mounted on said bobbin and connected to the other end of said electric coil;

a yoke of magnetic material connected to the opposite end of said core and covering at least a portion of said electric coil; and a second connection arm connected to said yoke and said first connection arm to electrically connect said bobbin coil to said yoke.

2. A solenoid apparatus according to claim 1, wherein said first connection arm extends parallel to the axis of said coil and is provided with a slot in one end thereof and said connection arm extends perpendicular to the axis of said coil and extends into said slot in engagement with said first connection arm.

3. A solenoid apparatus as set forth in claim 2, wherein said first connection arm is of integral, one piece construction with said first terminal.

4. A solenoid apparatus as set forth in claim 2, wherein said second connection arm is of integral, one piece construction with said magnetic yoke.

wherein said second connection arm is secured to said yoke by welding.

* * * * *